US008117730B2

(12) United States Patent
Lin et al.

(10) Patent No.: US 8,117,730 B2
(45) Date of Patent: Feb. 21, 2012

(54) METHOD OF MANUFACTURING LAZURITE-MADE FAUCET AND APPARATUS THEREOF

(76) Inventors: Han-Pin Lin, Sioushuei Township, Changhua County (TW); Yoau-Chau Jeng, Sioushuei Township, Changhua County (TW)

( * ) Notice: Subject to any disclaimer, the term of this patent is extended or adjusted under 35 U.S.C. 154(b) by 0 days.

(21) Appl. No.: 12/408,001

(22) Filed: Mar. 20, 2009

(65) Prior Publication Data

US 2011/0108131 A1 May 12, 2011

(51) Int. Cl.
*B21B 1/46* (2006.01)

(52) U.S. Cl. ..... 29/527.1

(58) Field of Classification Search ..... 29/527.1, 29/527.2, 527.3, 527.5, 458, 460; 264/219; 425/176

See application file for complete search history.

*Primary Examiner* — John C Hong

(74) *Attorney, Agent, or Firm* — Jackson IPG PLLC; Demian K. Jackson

(57) ABSTRACT

A method of manufacturing lazurite-made faucet and apparatus thereof makes use of injecting wax into a soft silicone mold to form a wax mold, coating gypsum on the wax mold to form a gypsum body, heating the gypsum body to melt and guide the wax mold thereout to form a hollow gypsum body. Alternatively, a stainless steel body can be coated by gypsum to be placed in a shaping cast, and a heating furnace filled for melting lazurite pellets into liquid lazurite and dripping them into the shaping cast to fill the vacant space between the bodies and the shaping cast. After cooling, the shaping cast is taken out to attain a preliminary lazurite-material faucet body. Lastly, the gypsum body is smashed to shape the lazurite-made faucet body; with a further surface processing procedure and assembling with other parts, a satisfied and worthy lazurite-made faucet is achieved.

15 Claims, 5 Drawing Sheets

METHOD OF MANUFACTURING LAZURITE-MADE FAUCET AND APPARATUS THEREOF

BACKGROUND OF THE INVENTION

1. Field of the Invention

The present invention relates to a method of manufacturing lazurite-made faucet and apparatus thereof, in particular to manufacture a lazurite-made faucet by injecting the lazurite into a vacant space between a gypsum body or a stainless steel body coated by gypsum.

2. Description of the Related Art

Typically, materials applied in faucets are generally copper and the manufacture thereof are casting. Thereafter, the copper faucet has to be electroplated on the surface thereof to obtain a glossy exterior. However, the glossy exterior facilely becomes soiled in view of a long-term erosion of limescale, which would therefore consume a frequent wipe for the faucet and render the occurrences of oxidizing glossy faucet and flaking the electroplating off under the cleanness periods. Moreover, multiple products of faucet are provided on the market and benefits to dealers are limited due to the great competition thereof.

SUMMARY OF THE INVENTION

1. The method of manufacturing lazurite-made faucet comprising steps of:
   a. injecting wax into a soft silicone mold to form a wax mold;
   b. placing the wax mold in a gypsum cast and injecting gypsum therein so as to coat the max mold with a thickness of gypsum body on the periphery thereof;
   c. heating and melting the wax mold within the gypsum body and pouring the melted wax mold out of the gypsum body, so that a hollow gypsum body is formed;
   d. arranging the hollow gypsum body into a shaping cast and putting the shaping cast in a heating furnace;
   e. preparing a plurality of lazurite pellets inside the heating furnace and melting the pellets into liquid lazurite by a heating device so that drops of the liquid lazurite could slowly drip into the shaping cast to fill a vacant space between the gypsum body and the shaping cast;
   f. taking the shaping cast out after cooling the liquid lazurite;
   g. destructing the gypsum body within the lazurite to form a preliminary lazurite-material faucet body; and
   h. proceeding a surface processing procedure to create an integral lazurite faucet body and assembling the faucet body with other parts to obtain a pleasing and valuable lazurite-made faucet.
2. The method of manufacturing lazurite-made faucet comprising steps of:
   a. preliminarily preparing a stainless steel body formed by stainless steel;
   b. soaking the stainless steel body in gypsum to become a gypsum-coated stainless steel body;
   c. directly placing the gypsum-coated stainless steel body into a shaping cast after the gypsum is solidified;
   d. placing the shaping cast in a heating furnace;
   e. preparing a plurality of lazurite pellets inside the heating furnace and melting the pellets into liquid lazurite by a heating device so that drops of the liquid lazurite could slowly drip the shaping cast to fill a vacant space between the gypsum-coated stainless steel body and the shaping cast;

f. releasing the shaping cast from the heating furnace after cooling the liquid lazurite to form a preliminary lazurite-material faucet body; and
   g. applying a surface processing procedure on a surface of the preliminary lazurite-material faucet body to accomplish an integral faucet body and assembling the faucet body with other parts to obtain a pleasing and valuable lazurite-made faucet.
3. The method of the present invention, wherein, various crystal materials and pigments can be mixed in the weight proportion of 3:1 and accordingly be produced into lazurite blocks, so as to fracture the lazurite blocks into lazurite pellets in response to the desired colors.
4. The method of the present invention, wherein, a weight proportion of gesso and water existed in the gypsum body is preferably 2.5:1.
5. The method of the present invention, wherein, the temperature of the heating furnace is controlled between 800~850 degrees centigrade so as to melt the lazurite pellets into liquid lazurite.
6. The method of the present invention, wherein, the injection of the liquid lazurite among the gypsum cast and the shaping cast is sintered and cooled by reducing the heating device of the heating furnace in a temperature range from 800 degrees centigrade to 600 degrees centigrade approximately for two hours, further to the temperature decreased from 600 degrees centigrade to 400 degrees centigrade for about three hours and from 400 degrees centigrade to 200 degrees centigrade for about four hours, and thence the temperature going in the temperature range below 200 degrees centigrade for about three hours, so that a broken lazurite can be avoided while open shaping cast after sintering.
7. The method of the present invention, wherein, the cooling procedure is proceeded after injecting the liquid lazurite between the gypsum cast and the shaping cast by controlling the temperature of the heating device of heating furnace from 800 degrees centigrade decreased with a temperature gradient of 50 degrees centigrade/hr to about 450 degrees centigrade that would thence maintain for one hour, and thereafter the temperature is decreased with a temperature gradient of 50 degrees centigrade/hr until it reduces from 450 degrees centigrade to 25 degrees centigrade, so that a broken lazurite can be avoided while taking the shaping cast from the heating furnace and opening it.
8. The method of the present invention, wherein, a heating and wax-melting device serving to melting the wax mold is controlled in the temperature of 140 degrees centigrade, so that the wax mold can be guided out from the inner of the gypsum body after melting.
9. The apparatus of manufacturing lazurite-made faucet comprising:
   a soft silicone mold injected by wax to form a wax mold; wherein, the silicone mold having an inner space equivalent to a mold of the faucet but smaller than the inner space of the gypsum cast;
   a gypsum cast having a larger inner space than that of the wax mold, so that the wax mold can be placed therein to reserve a vacant space between the wax mold and the gypsum cast where the gypsum could fill, hence a gypsum body being formed;
   a heating and wax-melting device having a controlled temperature at 140 degrees centigrade to melt and guide the wax mold within the gypsum cast out thereof to form a hollow gypsum cast;
   a shaping cast defining a dripping spout communicated with an inner space of the shaping cast for liquid lazurite to travel therethrough; the inner space being larger than the dimension of the gypsum body for accommodating the gypsum body and forming a vacant space between the inner space of the shaping cast and the gypsum body; the shaping cast being placed in a heating furnace, so that the liquid lazurite can travel through the dripping spout to fill the vacant space and form a preliminary lazurite faucet body; and a heating furnace defining a funnel thereon with a heating device on the outside thereof; a plurality of lazurite pellets being placed in the funnel, and the dripping spout of the shaping cast being defined at a corresponding position below an outlet of the funnel; whereby, the lazurite pellets and the shaping cast being concurrently heated by the heating device, so that the lazurite pellets could be melted and become liquid lazurite which is allowed to slowly travel through the outlet of the funnel and drip into the dripping spout of the shaping cast for entering into the vacant space between the shaping cast and the gypsum body and proceeding a sintering;

Accordingly, the shaping cast can be taken out from the heating furnace after cooling and opened to produce a preliminary lazurite-material faucet body. The gypsum body in the faucet body can be broken to execute a surface processing procedure to form an integral lazurite faucet body that would further assemble with other parts to accomplish a pleasing and valuable lazurite-made faucet thereof.

10. The apparatus of manufacturing lazurite-made faucet comprising:

a stainless steel body preliminarily formed and soaked in gypsum to form a gypsum-coated stainless steel body, so that the gypsum-coated stainless steel body could be directly placed in a shaping cast to reserve a vacant space for liquid lazurite to fill;

a shaping cast defining a dripping spout communicated with an inner space of the shaping cast where the gypsum-coated stainless steel body could stay for the liquid lazurite to travel therethrough; the shaping cast being placed in a heating furnace, so that the liquid lazurite can pass through the dripping spout to fill the vacant space;

a heating furnace defining a funnel thereon with a heating device on the outside thereof; a plurality of lazurite pellets being placed in the funnel, and the dripping spout of the shaping cast being defined at a corresponding position below an outlet of the funnel; whereby, the lazurite pellets and the shaping cast being concurrently heated by the heating device, so that the lazurite pellets could be melted and become liquid lazurite so as to slowly travel through the outlet of the funnel and drip into the dripping spout of the shaping cast for filling the vacant space to proceed sintering;

Hence, the shaping cast can be taken out from the heating furnace after cooled and opened to produce a preliminary lazurite-material faucet body that could thence proceed with a surface processing procedure and assemble with other parts to obtain a pleasing and valuable lazurite-made faucet.

The advantages of the present invention over the known prior arts will become more apparent to those of ordinary skilled in the art by reading the following descriptions with relating drawings.

DETAILED DESCRIPTION OF THE PREFERRED EMBODIMENTS

Figure 1:
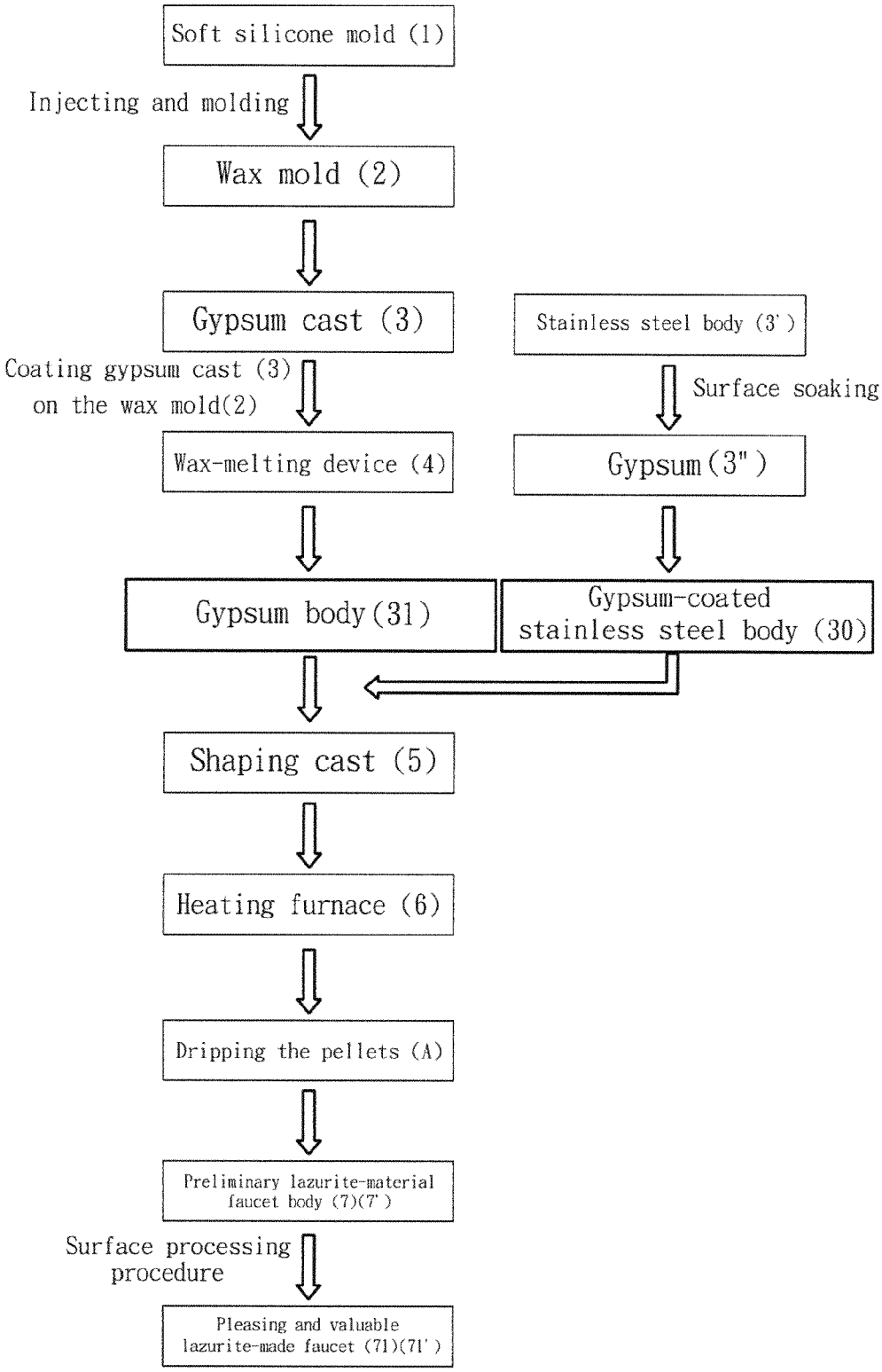
FIG. 1 is a flow block diagram showing the method of the present invention.

Before describing in greater detail, it should note that the like elements are denoted by the similar reference numerals throughout the disclosure.

Figure 2:
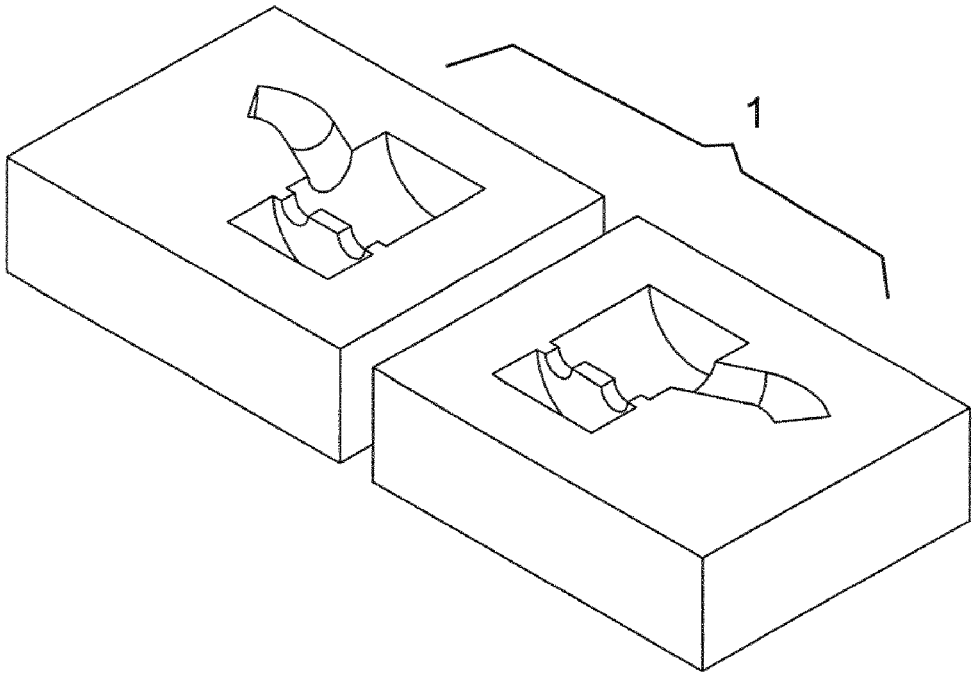
FIG. 2 is a perspective view showing soft silicone mold injected by wax of the present invention.
Figure 3:
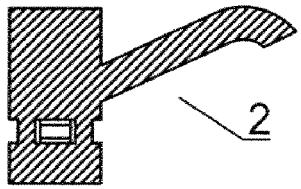
FIG. 3 is a schematic view showing the wax mold taken out from the soft silicone mold of the present invention.
Figure 4:
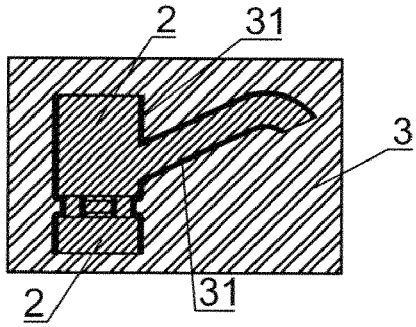
FIG. 4 is a schematic view showing the wax mold in the gypsum body of the present invention.
Figure 5:
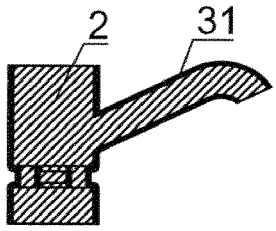
FIG. 5 is a schematic view showing the wax mold coated by the gypsum body and taken out from the gypsum cast.
Figure 6:
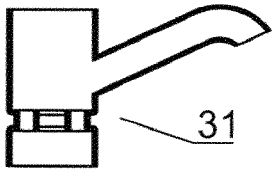
FIG. 6 is schematic view showing gypsum body after the wax mold on the periphery thereof being melted.
Figure 7:
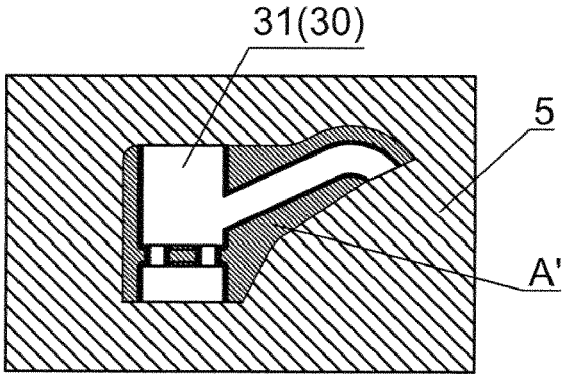
FIG. 7 is a schematic view showing the gypsum body injected by liquid lazurite in the shaping cast.
Figure 8:
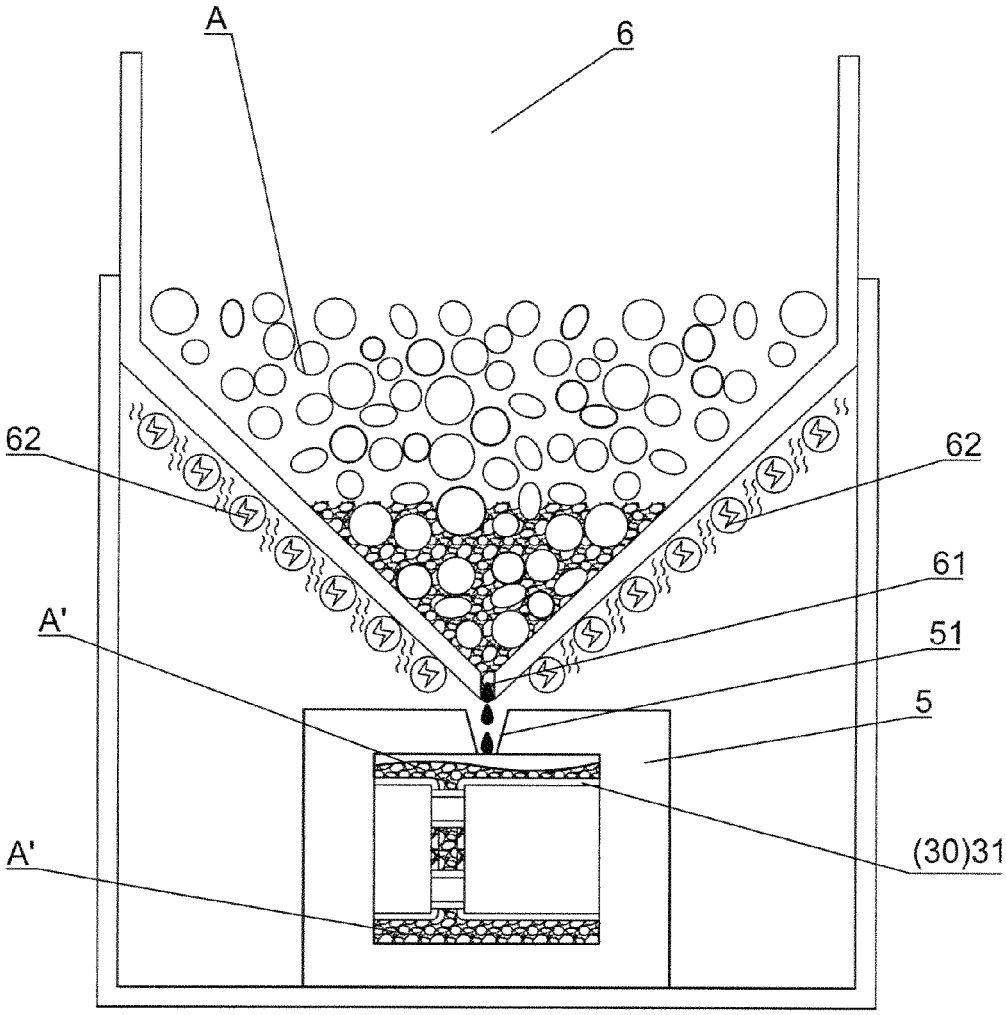
FIG. 8 is a schematic view showing the heating device and the shaping of the lazurite-made faucet.
Figure 10:
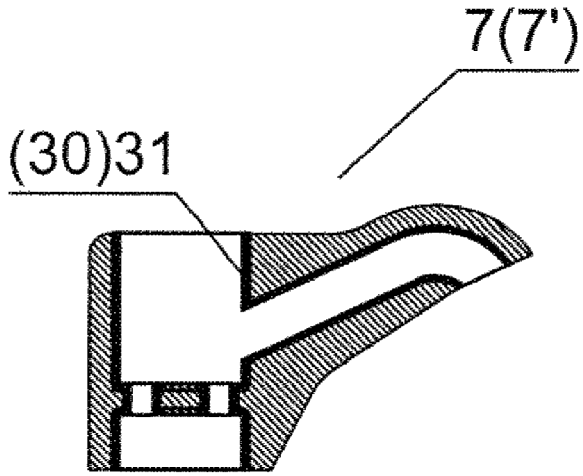
FIG. 10 is a cross-sectional view showing the lazurite-made faucet body of the present invention.

Referring to FIGS. 1 to 8, showing a first embodiment of the method of manufacturing lazurite-made faucet comprises steps of:

a. wax injection: a soft silicone mold 1 is injected by wax to form a wax mold 2 (as shown in FIG. 2);

b. gypsum cast coating: the wax mold 2 is placed in a gypsum cast 3 and injected by gypsum so as to coat the wax mold 2 with a gypsum body 31 (as shown in FIG. 4);

c. wax melting and hollow gypsum body generation: the wax mold 2 is melted in the gypsum body 31 by a heating and wax-melting device 4 and released from the gypsum body 31, so that a hollow space being formed inside the gypsum body 31 (as shown from FIGS. 5 to 6);

d. vacant space generation: the empty gypsum body 31 (as shown in FIG. 6) is placed in a shaping cast 5 (as shown in FIG. 7) to reserve a vacant space between the gypsum body 31 and the shaping cast 5;

e. placing: the shaping cast 5 is placed in a heating furnace 6 (as shown in FIG. 8);

f. heating and melting: a plurality of lazurite pellets A are melted into liquid lazurite A' and slowly dripped into the shaping cast 5 to fill the vacant space between the gypsum body 31 and the shaping cast 5 (as shown in FIGS. 7 and 8);

g. cooling and opening: the shaping cast 5 is taken out after cooling the liquid lazurite and opened to create a preliminary lazurite-material faucet body 7 (as shown in FIG. 10);

h. destruction: the gypsum body 31 within the preliminary lazurite-material faucet body 7 is broken; and i. faucet accomplishment: the preliminary faucet body 7 is subjected to a surface processing procedure and assembled with other parts to obtain a pleasing and valuable lazurite-made faucet 71.

Figure 9:
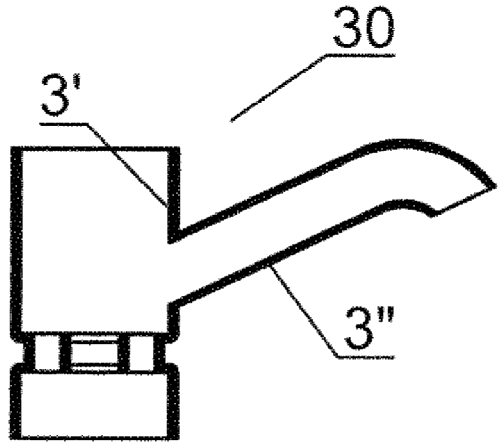
FIG. 9 is a schematic view showing the stainless steel body coated by gypsum.

Referring to FIGS. 1 and 7 to 10 showing a second preferred embodiment of the method of manufacturing lazurite-made faucet comprising steps of:

a. preparation: a stainless steel body 3' is preliminarily formed by stainless steel;

b. soaking: the stainless steel body 3' is soaked in a gypsum 3" to become a gypsum-coated stainless steel body 30 (as shown in FIG. 9);

c. solidification: the gypsum-coated stainless steel body 30 is placed in a shaping cast 5 after the gypsum 3" is coagulated (as shown in FIG. 7);

d. placing: the gypsum-coated stainless steel body 30 is placed in the shaping cast 5, and the afore shaping cast 5 is further put into a heating furnace 6 (as shown in FIG. 8);

e. heating and melting: a plurality of lazurite pellets A are placed in the heating furnace 6, and the pellets A are melted into liquid lazurite A' after heating to slowly drop into the shaping cast 5 and fill a vacant space between the gypsum-coated stainless steel body 30 and the shaping cast 5 (as shown in FIGS. 7 and 8);

f. cooling and opening: the shaping cast 5 is taken out of the heating furnace 6 after cooled and opened;

g. preliminary generation: a preliminary lazurite-material faucet body 7' with gypsum-coated stainless steel faucet body 30 is thence formed (as shown in FIG. 10); and h. faucet accomplishment: a surface processing procedure is applied to the faucet body 7' and assembling it with other essential parts to obtain a pleasing and valuable lazurite-made faucet 71'.

Further, colors of the lazurite pellets A can be mixed in the weight proportion of three parts various crystal materials and one part of pigments (3:1) to form into lazurite blocks, and thereafter those blocks are able to be divided into pellets A with needed colors.

A weight proportion of gesso and water of the gypsum body 31 and the gypsum 3" in FIGS. 4 to 6 and 9 are preferably at 2.5:1.

Further, the temperature of the heating furnace 6 is controlled between 800~850 degrees centigrade so as to melt the lazurite pellets A into liquid lazurite A' as depicted in FIG. 8. Moreover, cooling should be employed after sintering the gypsum cast 3 and the shaping cast 5 injected by liquid lazurite A'. To avoid the fragmentation of the solid lazurite that possess property of hot expansion and cold shrink under a quick cooling and shaping, the cooling of the present method should be progressive. That is, the cooling temperature inside the heating furnace 6 is controlled by the heating device 62, of which the temperature decreases from 800 degrees centigrade to 600 degrees centigrade for about two hours, further declines the temperature from 600 degrees centigrade to 400 degrees centigrade for about three hours and then reaches the temperature range from 400 degrees centigrade to 200 degrees centigrade approximately for four hours, and thence attains the temperature below 200 degrees centigrade for three hours, so that a broken lazurite can be avoided while opening the shaping cast 5 that have been sintered.

In addition, afore cooling temperature of the heating device 62 of the heating furnace 6 can also be controlled by another proper way. For example, the cooling procedure is alternatively proceeded after injecting the liquid lazurite between the gypsum cast and the shaping cast by controlling the temperature of the heating device of heating furnace from 800 degrees centigrade decreased with a temperature gradient of 50 degrees centigrade/hr to about 450 degrees centigrade that would thence maintain for one hour, and thereafter the temperature is decreased with a temperature gradient of 50 degrees centigrade/hr until it reduces from 450 degrees centigrade to 25 degrees centigrade, so that a broken lazurite can be avoided while taking the shaping cast 5 from the heating furnace 6 and opening it.

It should be noted that, as shown in FIG. 5, the temperature of a heating and wax-melting device 4 that serves to melt the wax is controlled to about 140 degrees centigrade, so that the wax can be guided out from the interior of the gypsum body 31 after melting.

Referring to FIGS. 1 to 8 and 10 shows the apparatus made by the first preferred method that comprises:

a soft silicone mold 1 injected by wax to form a wax mold 2 having an inner space equivalent to a mold of the faucet but smaller than the inner space of a gypsum cast 3;

a gypsum cast 3 having a larger inner space than that of the wax mold 2, so that the wax mold 2 can be placed therein to reserve a vacant space between the wax mold 2 and the gypsum cast 3; wherein, a proper amount of gypsum can fill the vacant space to form a gypsum body 31;

a heating and wax-melting device 4 in the temperature at 140 degrees centigrade serving to melt and releasing the wax mold 2 within the gypsum body 31, so as to form a hollow gypsum body 31;

a shaping cast 5 defining a dripping spout 51 communicated with an inner space of the shaping cast 5 for liquid lazurite A' to travel through, of which the inner space is larger than that of the gypsum cast 3 to form a vacant space between the inner space of the shaping cast 5 and the gypsum cast 3 while arranging the gypsum cast 3 therein. Hereby, the shaping cast 5 can be placed into a heating furnace 6 to permit liquid lazurite A' to travel through the dripping spout 51 and to fill the vacant space and form a gypsum body 31; and a heating furnace 6 defining a funnel 61 thereon with a heating device 62 on the outside thereof; a plurality of lazurite pellets A are placed in the funnel 61, and the dripping spout 51 is defined at a corresponding position below an outlet 611 of the funnel 61; whereby, the lazurite pellets A and the shaping cast 5 are concurrently heated by the heating device 62, so that the lazurite pellets A could be melted and become liquid lazurite A' so as to slowly drip into the dripping spout 51 of the shaping cast 5 by traveling through the outlet 611 of the funnel 61 and forward into the shaping cast 5 to fill the vacant space in the gypsum body 31 and proceed the process of sintering; and Hence, the shaping cast 5 can be taken out from the heating furnace 6 after cooled and opened; afterward, a preliminary lazurite-material faucet body 7 can be formed by breaking the gypsum body 31; a surface processing procedure is utilized and the faucet body 7 is further installed with other essential parts thereby obtaining a pleasing and valuable lazurite-made faucet.

Referring to FIGS. 1, 7, 8, and 10 show another apparatus made by the second preferred method that comprises:

a stainless steel body 3' is preliminarily formed and soaked in gypsum 3" to form a gypsum-coated stainless steel body 30, which would be placed in a shaping cast 5 to reserve a vacant space for being filled with liquid lazurite A';

the shaping cast 5 defining a dripping spout 51 communicated with an inner space of the shaping cast 5 for the liquid lazurite A' to travel through, so that the gypsum-coated stainless steel body 30 would be placed therein; in addition, the shaping cast 5 can be placed in a heating furnace 6, so as to drip liquid lazurite A' from the dripping spout 51 into the shaping cast 5 to fill the vacant space and form a preliminary lazurite-material faucet body 7'; and a heating furnace 6 defining a funnel 61 thereon with a heating device 62 on the outside thereof; wherein, a plurality of lazurite pellets A are placed in the funnel 61, and the dripping spout 51 of the shaping cast 5 is defined at a corresponding position under an outlet 611 of the funnel 61; whereby, the lazurite pellets A and the shaping cast 5 are concurrently heated by the heating device 62, so that the lazurite pellets A could be melted and become liquid lazurite A' so as to travel through the outlet 611 of the funnel 61 and slowly flow into the dripping spout 51 of the shaping cast 5; thereby, the liquid lazurite A' would get into the shaping cast 5 to fill the vacant space, so that sintering and solidification can be occurred;

Hence, the shaping cast 5 can be taken out from the heating furnace 6 after cooling and thence proceed releasing the solid lazurite to produce a preliminary lazurite-material faucet body 7'; the faucet body 7' thence accepts the application of a surface process and assembles with other parts, therefore obtaining a pleasing and valuable lazurite-made faucet 71'.

Additionally, means that are applicable to manufacture parts integral with the faucets 71 and 71' such as handles, valves, and other ornaments thereof can be produced by the above methods thereof.

While we have shown and described the embodiment in accordance with the present invention, it should be clear to those skilled in the art that further embodiments may be made without departing from the scope of the present invention.

We claim:

1. A method of manufacturing lazurite-made faucet comprising steps of:

a. injecting wax into a soft silicone mold to form a wax mold;

b. placing said wax mold in a gypsum cast and injecting gypsum inside said gypsum cast so as to coat said wax mold with by a thickness of gypsum body;

c. heating and melting said wax mold in said gypsum body by a heating and wax-melting device and moving said melted wax mold out of said gypsum body, so as to define a hollow gypsum body;

d. putting said gypsum body in a shaping cast to reserve a vacant space between said gypsum body and said shaping cast;

e. placing said shaping cast inside a heating furnace;

f. melting a plurality of lazurite pellets placed inside said heating furnace into liquid lazurite and rendering drops of said pellets slowly dripped into said shaping cast to fill said vacant space between said gypsum body and said shaping cast;

g. taking said shaping cast out of said furnace after proceeding procedures of cooling and opening to shape a preliminary lazurite-material faucet body;

h. destructing said gypsum body within said preliminary lazurite-material faucet body; and i. applying a surface processing procedure and assembling said faucet body with other parts to obtain a pleasing and valuable lazurite-made faucet.

2. The method as claimed as claimed 1, wherein, various crystal materials and pigments are mixed in a weight proportion of 3:1 to generate lazurite blocks, which would be fractured into to said lazurite pellets performed by desired colors.

3. The method as claimed in claim 1, wherein, a weight proportion of gesso and water of said gypsum body is preferably 2.5:1.

4. The method as claimed in claim 1, wherein, the temperature of said heating furnace is controlled between 800~850 degrees centigrade so as to melt said lazurite pellets into liquid lazurite.

5. The method as claimed in claim 1, wherein, an injection of said liquid lazurite among said gypsum cast and said shaping cast is sintered and cooled by reducing said heating device of said heating furnace in a temperature range from 800 degrees centigrade to 600 degrees centigrade approximately for two hours, further said temperature decreased from 600 degrees centigrade to 400 degrees centigrade for about three hours and from 400 degrees centigrade to 200 degrees centigrade for about four hours, and thence said temperature going in said temperature range below 200 degrees centigrade for about three hours, so that a broken lazurite can be avoided while open shaping cast after sintering.

6. The method as claimed in claim 1, wherein, a heating device inside said heating furnace proceeds to sinter and cool said shaping cast after injecting said liquid lazurite among said gypsum body and said shaping cast by reducing the temperature from 800 degrees centigrade with a gradient of 50 degrees centigrade per hour toward 450 degrees centigrade whose declination temporarily stops for one hour, and thereafter, the temperature continuing decreasing from 450 degrees centigrade to 25 degrees centigrade with a gradient of 50 degrees centigrade per hour, so that a broken lazurite can be avoided while taking said shaping cast from said heating furnace and opening it.

7. The method as claimed in claim 1, wherein, the temperature of said heating and wax-melting device is controlled to 140 degrees centigrade, so that said wax mold can be guided out from the inner of said gypsum body after melting.

8. The method as claimed in claim 1, wherein, handles, valves, and other ornaments thereof can be manufactured by the above methods thereof.

9. A method of manufacturing lazurite-made faucet comprising:

a. preliminarily preparing a stainless steel body formed by stainless steel;

b. soaking said stainless steel body in gypsum to become a gypsum-coated stainless steel body;

c. directly placing said gypsum-coated stainless steel body into a shaping cast after said gypsum being solidified;

d. placing said gypsum-coated stainless steel body in said shaping cast, and thereafter further placing said shaping cast in a heating furnace;

e. preparing a plurality of lazurite pellets inside said heating furnace and melting said pellets into liquid lazurite by a heating device, so that drops of said liquid lazurite could slowly drip said shaping cast to fill a vacant space between said gypsum-coated stainless steel body and said shaping cast;

f. releasing said shaping cast from said heating furnace after cooling;

g. shaping a preliminary lazurite-material faucet body inside said gypsum-coated stainless steel body; and h. applying a surface processing procedure on a surface of said preliminary lazurite-material faucet body and assembling said faucet body with other parts to obtain a pleasing and valuable lazurite-made faucet.

10. The method as claimed as claimed 9, wherein, various crystal materials and pigments can be mixed in the weight proportion of 3:1, and accordingly be produced into lazurite blocks, so as to fracture said lazurite blocks into lazurite pellets with needed colors.

11. The method as claimed in claim 9, wherein, the temperature of said heating furnace is controlled between 800~850 degrees centigrade so as to melt the lazurite pellets into liquid lazurite.

12. The method as claimed in claim 9, wherein, the injection of said liquid lazurite among said gypsum cast and said shaping cast is sintered and cooled by reducing said heating device of said heating furnace in a temperature range from 800 degrees centigrade to 600 degrees centigrade approximately for two hours, further to the temperature decreased from 600 degrees centigrade to 400 degrees centigrade for about three hours, and from 400 degrees centigrade to 200 degrees centigrade for about four hours, and thence the temperature going in the temperature range below 200 degrees centigrade for about three hours, so that a broken lazurite can be avoided while open shaping cast after sintering.

13. The method as claimed in claim 9, wherein, the cooling procedure is proceed after injecting said liquid lazurite between said gypsum cast and said shaping cast by controlling the temperature of said heating device of said heating furnace from 800 degrees centigrade decreased with a temperature gradient of 50 degrees centigrade per hour to about 450 degrees centigrade that would thence maintain for one hour, and thereafter, the temperature is decreased with a temperature gradient of 50 degrees centigrade per hour until it reduces from 450 degrees centigrade to 25 degrees centigrade so that a broken lazurite can be avoided while taking said shaping cast from said heating furnace and opening it.

14. The method as claimed in claim 9, wherein, a heating and wax-melting device serving to melting said wax mold is controlled in the temperature of 140 degrees centigrade, so that said wax mold can be guided out from the inner of the gypsum body after melting.

15. The method as claimed in claim 9, wherein, handles, valves, and other ornaments thereof can be manufactured by the above methods thereof.

* * * * *